US008187779B2

(12) United States Patent
Kunii et al.

(10) Patent No.: US 8,187,779 B2
(45) Date of Patent: May 29, 2012

(54) TONER FOR ELECTROSTATIC IMAGE DEVELOPMENT

(75) Inventors: Satoshi Kunii, Wakayama (JP); Masahito Yamazaki, Wakayama (JP)

(73) Assignee: Kao Corporation, Tokyo (JP)

( * ) Notice: Subject to any disclaimer, the term of this patent is extended or adjusted under 35 U.S.C. 154(b) by 118 days.

(21) Appl. No.: 12/434,323

(22) Filed: May 1, 2009

(65) Prior Publication Data

US 2009/0280426 A1 Nov. 12, 2009

(30) Foreign Application Priority Data

May 12, 2008 (JP) ..... 2008-124896

(51) Int. Cl.
*G03G 9/00* (2006.01)

(52) U.S. Cl. ..... 430/108.23; 430/109.4; 430/124.1

(58) Field of Classification Search ..... 430/108.23, 430/109.4, 124.1
See application file for complete search history.

(56) References Cited

U.S. PATENT DOCUMENTS

| | | | | |
|---|---|---|---|---|
| 4,657,837 | A * | 4/1987 | Morita et al. | 430/109.4 |
| 5,053,828 | A * | 10/1991 | Ndebi et al. | 399/308 |
| 5,079,123 | A | 1/1992 | Nanya et al. | |
| 5,395,726 | A | 3/1995 | Tavernier et al. | |
| 5,483,327 | A * | 1/1996 | Taya et al. | 399/223 |
| 2007/0292779 | A1 * | 12/2007 | Sato et al. | 430/48 |

FOREIGN PATENT DOCUMENTS

| | | | |
|---|---|---|---|
| JP | 3-5764 | | 1/1991 |
| JP | 6-282102 | | 10/1994 |
| JP | 8-20636 | | 1/1996 |
| JP | 10-239903 | | 9/1998 |
| JP | 11-133668 | | 5/1999 |
| JP | 2003-149865 | | 5/2003 |
| JP | 2004-271685 | * | 9/2004 |
| JP | 2006-47879 | | 2/2006 |
| JP | 2007-334139 | | 12/2007 |

OTHER PUBLICATIONS

U.S. Appl. No. 12/689,531, filed Jan. 19, 2010, Kunii, et al.
U.S. Appl. No. 12/559,064, filed Sep. 14, 2009, Kunii, et al.

* cited by examiner

*Primary Examiner* — Thorl Chea
(74) *Attorney, Agent, or Firm* — Oblon, Spivak, McClelland, Maier & Neustadt, L.L.P.

(57) ABSTRACT

A toner for electrostatic image development containing a resin binder and a charge control agent, wherein the resin binder contains a polyester A obtained by polycondensing a carboxylic acid component containing isophthalic acid and/or an ester thereof, and an alcohol component, and wherein the charge control agent contains an azo-iron complex represented by the formula (I):

(I)

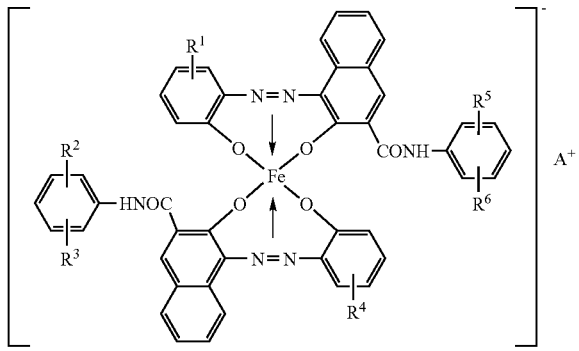

wherein each of $R^1$ and $R^4$, which may be identical or different, is a linear or branched alkyl group having 3 to 8 carbon atoms; each of $R^2$, $R^3$, $R^5$, and $R^6$, which may be identical or different, is a hydrogen atom, an alkyl group having 1 to 8 carbon atoms, an alkoxy group having 1 to 8 carbon atoms, a halogen atom, a nitro group, or a carboxyl group; and $A^+$ is a cation. The toner for electrostatic image development is suitably used in developing latent images formed in, for example, electrophotography, an electrostatic recording method, an electrostatic printing method, or the like.

20 Claims, No Drawings

TONER FOR ELECTROSTATIC IMAGE DEVELOPMENT

FIELD OF THE INVENTION

The present invention relates to a toner for electrostatic image development usable in developing latent images formed in, for example, electrophotography, an electrostatic recording method, an electrostatic printing method, or the like, and a method of forming fixed images using the toner.

BACKGROUND OF THE INVENTION

In recent years, with the growth of the print-on-demand market, the demands for speeding up electrophotographic techniques are all the more increasing. In view of the above, as a means for meeting the requirement of speeding up, a toner that is capable of fixing at a low temperature is studied in order to fix the toner on paper with less energy. For example, a toner having excellent low-temperature fixing ability by containing a linear low-softening point polyester as a resin binder (see JP-A-Hei-3-5764 (U.S. Pat. No. 5,079,123), JP-A-Hei-6-282102 (U.S. Pat. No. 5,395,726), and the like); a method for producing a toner including the step of melt-kneading under specified conditions, using a resin binder containing a polyester having a softening point of from 90° to 110° C. and a low-melting point wax having a melting point of from 60° to 90° C. (see JP-A-2006-47879, and the like); and the like are proposed.

Further, in order to control an increase in toner scattering, i.e. toner dust, caused by the speeding up of a developer device, a polyester having a high triboelectric chargeability obtained from an aromatic monomer such as terephthalic acid as a raw material monomer for a resin binder is widely used. In addition, with the speeding up, mechanical stress applied to a toner also increases, so that durability is lowered; however, by using the above aromatic monomer, the glass transition temperature of the polyester is increased, and durability is also increased (see JP-A-2003-149865, and the like).

On the other hand, as a new charge control agent having a quick initial rise of triboelectric charges and excellent environmental stability, a specified azo-iron complex is reported in JP-A-2007-334139.

SUMMARY OF THE INVENTION

The present invention relates to:

[1] a toner for electrostatic image development containing (a) a resin binder and (b) a charge control agent, wherein the resin binder contains a polyester A obtained by polycondensing a carboxylic acid component containing isophthalic acid and/or an ester thereof, and an alcohol component, and wherein the charge control agent contains an azo-iron complex represented by the formula (I):

(I)

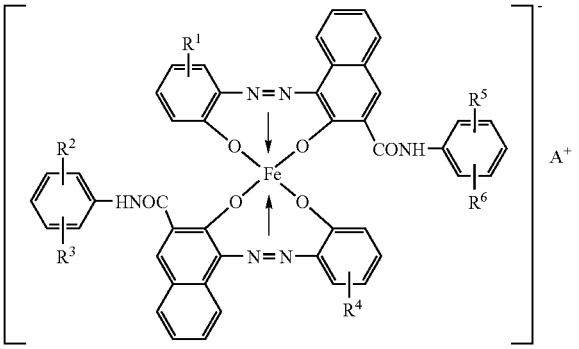

wherein each of $R^1$ and $R^4$, which may be identical or different, is a linear or branched alkyl group having 3 to 8 carbon atoms; each of $R^2$, $R^3$, $R^5$, and $R^6$, which may be identical or different, is a hydrogen atom, an alkyl group having 1 to 8 carbon atoms, an alkoxy group having 1 to 8 carbon atoms, a halogen atom, a nitro group, or a carboxyl group; and $A^+$is a cation; and

[2] a method of forming fixed images comprising applying the toner as defined in the above [1] to an image-forming apparatus according to a non-contact fusing method.

DETAILED DESCRIPTION OF THE INVENTION

The present invention relates to a toner for electrostatic image development, having excellent low-temperature fixing ability and triboelectric chargeability and providing even more excellent smearing property and transferability, thereby making it possible to maintain a stable image density without causing toner scattering, even in the formation of fixed images at high speeds, and a method of forming fixed images using the toner.

The toner for electrostatic image development of the present invention exhibits excellent effects that the toner has excellent low-temperature fixing ability and triboelectric chargeability and provides even more excellent smearing property and transferability, thereby making it possible to maintain a stable image density without causing toner scattering, even in the formation of fixed images at high speeds.

These and other advantages of the present invention will be apparent from the following description.

Even when an iron-azo complex described in JP-A-2007-334139 is used, smearing property and transferability are not sufficient, so that the image density is likely to be lowered and the toner scattering is likely to be generated.

A great feature of the toner for electrostatic image development of the present invention containing a resin binder and a charge control agent resides in that the toner contains a specified resin binder and a specified charge control agent.

The resin binder contains a polyester A obtained by polycondensing a carboxylic acid component containing isophthalic acid and/or an ester thereof (hereinafter also referred to as "isophthalic acid compound"), and an alcohol component. As in a conventional case, if a polyester having a low-softening point that can meet the demand for a non-contact fusing method is synthesized using terephthalic acid, from the viewpoint of triboelectric chargeability, the reactivity with terephthalic acid and the alcohol component is low, so that a low-molecular weight component such as a monomer or an oligomer remains, thereby leading to cause the lowering of elasticity of the resin. If a toner of which resin has a lowered elasticity is used in a high-speed apparatus for forming fixed images, a large stress is applied to the toner, and an external additive is easily embedded in the toner, so that transferability is worsened, and an image density is also lowered. By contrast, in the present invention, since isophthalic acid is used in the carboxylic acid component, its reactivity with the alcohol component is excellent, so that the residual monomers in the polyester can be dramatically reduced. Further, by combining an azo-iron complex mentioned later and the polyester, dispersibility of a charge control agent in the toner increases, so that a phenomenon in which a toner after fixing is removed at an interface of the charge control agent and the resin due to stress is reduced, thereby making smearing property excellent. Specifically, since isophthalic acid is an asymmetric monomer, a polymer chain is bent, thereby lowering crystallinity of the polyester, as compared to a case where a symmetric monomer such as terephthalic acid is used. Although not wanting to be limited by theory, it is presumed that if crystallinity is low, the interaction of the molecular chains themselves is weakened, so that the charge control agent is very highly dispersed by a combined use of a polyester having low crystallinity and a charge control agent having high dispersibility, whereby the phenomenon of removing a toner at an interface of the charge control agent and the resin is prevented.

In the present invention, if only a polyester obtained by using an aromatic carboxylic compound such as isophthalic acid as a carboxylic acid component is used, low-temperature fixing ability is not sufficient because of a rigid molecular backbone of the polyester. Therefore, it is preferable that one or more members selected from the group consisting of fumaric acid, maleic acid, maleic anhydride, and an ester thereof (which may be hereinafter referred to as a "fumaric acid/maleic acid compound") is further used as the carboxylic acid component of the polyester. The esters of isophthalic acid, fumaric acid and maleic acid include lower alkyl (1 to 6 carbon atoms) esters thereof, and the like.

The fumaric acid/maleic acid compound may be used as a carboxylic acid component of a polyester different from the polyester obtained by using a carboxylic acid component containing the isophthalic acid compound (a first embodiment), or the fumaric acid/maleic acid compound may be used as a carboxylic acid component of the same polyester together with the isophthalic compound (a second embodiment), and the first embodiment is preferable, from the viewpoint of improving durability and smearing property.

The first embodiment of the polyester in the present invention contains a polyester A obtained by polycondensing a carboxylic acid component containing an isophthalic acid compound, and an alcohol component, and a polyester B obtained by polycondensing a carboxylic acid component containing a fumaric acid/maleic acid compound, and an alcohol component.

The isophthalic acid compound in the polyester A is contained in an amount of preferably 50% by mol or more, more preferably 70% by mol or more, and even more preferably 90% by mol or more, of the carboxylic acid component.

In addition, the fumaric acid/maleic acid compound in the polyester B is contained in an amount of preferably 50% by mol or more, more preferably 70% by mol or more, and even more preferably 90% by mol or more, of the carboxylic acid component. Here, the isophthalic acid compound is preferably not contained in the carboxylic acid component of the polyester B. If contained, it is preferable that the isophthalic acid compound is contained in an amount of 5% by mol or less, of the carboxylic acid component. In addition, it is preferable that the fumaric acid/maleic acid compound is not contained in the carboxylic acid component of the polyester A, in a case where the polyester A is used together with the polyester B. If contained, it is preferable that the fumaric acid/maleic acid compound is contained in an amount of 5% by mol or less of the carboxylic acid component.

Here, the polyester A has an acid value of preferably less than 6 mg KOH/g, and more preferably less than 4 mg KOH/g, from the viewpoint of maintaining stable triboelectric chargeability even under various environmental conditions such as high temperatures and high humidity.

The polyester A and the polyester B in the resin binder are preferably in a weight ratio, i.e. the polyester A/the polyester B, of preferably from 90/10 to 50/50, and more preferably from 80/20 to 60/40, from the viewpoint of the low-temperature fixing ability, triboelectric chargeability, and image density.

A second embodiment of the polyester in the present invention is an embodiment in which the carboxylic acid component of the polyester A further contains a fumaric acid/maleic acid compound, in other words, the polyester contains a polyester C obtained by polycondensing a carboxylic acid component containing an isophthalic acid compound and a fumaric acid/maleic acid compound, and an alcohol component.

The isophthalic acid compound is contained in the polyester C in an amount of preferably 50% by mol or more, more preferably 60% by mol or more, and even more preferably 70% by mol or more, of the carboxylic acid component.

In addition, the fumaric acid/maleic acid compound in the polyester C is contained in an amount of preferably from 20 to 70 mol, more preferably from 30 to 60 mol, and even more preferably from 40 to 50 mol, based on 100 mol of the isophthalic acid compound.

The alcohol component of the polyester includes an alkylene oxide adduct of bisphenol A represented by the formula (II):

(II)

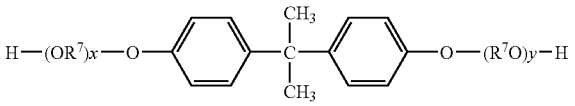

wherein each of $R^7O$ and $OR^7$ is an oxyalkylene group, wherein $R^7$ is an ethylene group and/or a propylene group; x and y are number of moles of alkylene oxides added, each being a positive number, wherein an average of the sum of x and y is preferably from 1 to 16, more preferably from 1 to 8, and even more preferably from 1.5 to 4;

ethylene glycol, propylene glycol, glycerol, pentaerythritol, trimethylolpropane, hydrogenated bisphenol A, sorbitol, or alkylene (2 to 4 carbon atoms) oxide (number of moles in average: 1 to 16) adducts thereof; and the like.

Among them, the alkylene oxide adduct of bisphenol A represented by the formula (II) is preferred, from the viewpoint of durability and triboelectric chargeability of the toner, and a propylene oxide adduct of bisphenol A where $R^7$ is a propylene group in the formula (II) is more preferred, from the viewpoint of increasing storage modulus at 50° C., thereby preventing an external additive from being embedded.

The alkylene oxide adduct of bisphenol A represented by the formula (II) is contained in an amount of preferably 5% by mol or more, more preferably 50% by mol or more, and even more preferably substantially 100% by mol, of the alcohol component.

In addition, the carboxylic acid component other than the isophthalic acid compound and the fumaric acid/maleic acid compound includes dicarboxylic acids such as phthalic acid, terephthalic acid, adipic acid, and succinic acid; succinic acids substituted with an alkyl group having 1 to 20 carbon atoms or an alkenyl group having 2 to 20 carbon atoms, such as dodecenylsuccinic acid and octenylsuccinic acid; tricarboxylic or higher polycarboxylic acids such as trimellitic acid and pyromellitic acid; acid anhydrides thereof and alkyl(1 to 8 carbon atoms) esters of these acids; and the like.

In addition, the alcohol component may properly contain a monohydric alcohol, and the carboxylic acid component may properly contain a monocarboxylic acid compound, from the viewpoint of adjusting its molecular weight, and the like.

In the present invention, it is preferable that all of the polyesters A to C are linear polyesters, from the viewpoint of low-temperature fixing ability. The linear polyester refers to a polyester containing a trivalent or higher polyvalent monomer, i.e. a trihydric or polyhydric alcohol and/or a tricarboxylic or higher polycarboxylic acid compound, in an amount of less than 1% by mol of a total amount of the carboxylic acid component and the alcohol component, and it is preferred that the trivalent or higher polyvalent monomer is not substantially contained. On the other hand, a nonlinear polyester refers to a polyester containing a trivalent or higher polyvalent monomer in an amount of 1% by mol or more of a total amount of the carboxylic acid component and the alcohol component. It is preferable that the resin binder of the toner of the present invention does not contain a nonlinear polyester, from the viewpoint of improving the low-temperature fixing ability of the toner.

The polyester is obtained by, for example, polycondensing an alcohol component and a carboxylic acid component in an inert gas atmosphere at a temperature of 180° to 250° C., using, if necessary, an esterification catalyst.

The polyester has a softening point of preferably from 90° to 120° C., more preferably from 95° to 115° C., and even more preferably from 100° to 110° C., from the viewpoint of low-temperature fixing ability and durability of the toner. It is preferable that the entire resin binder also has a softening point within the above range.

The polyester has a glass transition temperature of preferably from 50° to 85° C., and more preferably from 55° to 80° C., from the viewpoint of storage property of the toner.

In both the softening point and the glass transition temperature, in a case where the polyester contains plural polyesters as in the first embodiment mentioned above, it is preferable that a weighed average efficiency thereof is within the above-mentioned range.

Here, in the present invention, the polyester may be a modified polyester to an extent that its properties are not substantially impaired. The modified polyester refers to a grafted or blocked polyester with phenol, urethane, epoxy, or the like, in accordance with the methods described in, for example, JP-A-Hei-11-133668, JP-A-Hei-10-239903, JP-A-Hei-8-20636, and the like.

The polyester is contained in an amount of preferably from 70 to 100% by weight, and more preferably substantially 100% by weight, of the resin binder.

In the present invention, a resin binder may properly contain a polyester other than the above-mentioned polyesters and other resin binders to an extent that the effects of the present invention would not be impaired. Other resin binders include vinyl resins, epoxy resins, polycarbonates, polyurethanes, and the like.

The charge control agent contains an azo-iron complex represented by the formula (I):

(I)

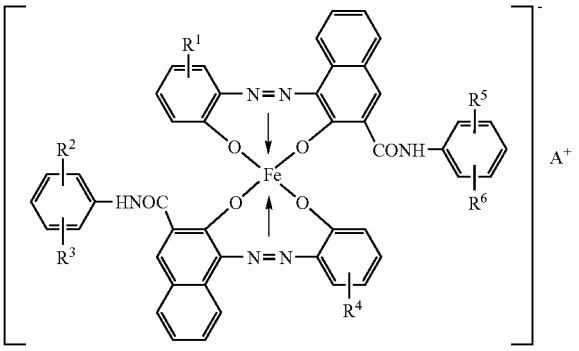

wherein each of $R^1$ and $R^4$, which may be identical or different, is a linear or branched alkyl group having 3 to 8 carbon atoms; each of $R^2$, $R^3$, $R^5$, and $R^6$, which may be identical or different, is a hydrogen atom, an alkyl group having 1 to 8 carbon atoms, an alkoxy group having 1 to 8 carbon atoms, a halogen atom, a nitro group, or a carboxyl group; and $A^+$ is a cation.

The azo-iron complex represented by the formula (I) is excellent in dispersibility, and is, as mentioned above, effective in the improvement of smearing property.

In the formula (I), each of $R^1$ and $R^4$, which may be identical or different, is a linear or branched alkyl group having 3 to 8 carbon atoms, and includes specifically an n-propyl group, an iso-propyl group, an n-butyl group, an iso-butyl group, a tert-butyl group, an n-pentyl group, an iso-pentyl group, a hexyl group, a heptyl group, an octyl group, and the like. $R^1$ or $R^4$ is preferably a butyl group, and more preferably a tert-butyl group, from the viewpoint of improving dispersibility of the charge control agent, and environmental stability, transferability, image density, and smearing property of the toner.

In the formula (I), each of the substituents $R^2$, $R^3$, $R^5$ and $R^6$ is a hydrogen atom, an alkyl group having 1 to 8 carbon atoms, including, for example, a methyl group, an ethyl group, an iso-propyl group, an n-butyl group, a tert-butyl group, a pentyl group, a hexyl group, a heptyl group, an octyl group, or the like; an alkoxy group having 1 to 8 carbon atoms, including, for example, a methoxy group, an ethoxy group, a propoxy group, a butoxy group, or the like; a halogen atom, including, for example, a fluorine atom, a chlorine atom, a bromine atom, an iodine atom, or the like, a nitro group or a carboxyl group.

The counterion $A^+$ of the above-mentioned azo-iron complex includes cations such as a hydrogen ion, a sodium ion, a potassium ion, and an ammonium ion. The counterion is preferably a potassium ion and a hydrogen ion, and more preferably a hydrogen ion, from the viewpoint of environmental stability. The molar ratio of the hydrogen ions that are present in the counterions of the above-mentioned azo-iron complex is preferably 70% or more, more preferably 90% or more, and even more preferably 99% or more, from the viewpoint of environmental stability.

Regarding the above-mentioned azo-iron complex, a detailed production method therefor is described, for example, in JP-A-2007-334139, or the like, and the azo-iron complex can be easily synthesized in accordance with the method.

The above-mentioned azo-iron complex has a specific volume resistivity of preferably from $0.2\times10^{15}$ to $7.0\times10^{15}$ Ωcm, and more preferably from $0.5\times10^{15}$ to $5.0\times10^{15}$ Ωcm, from the viewpoint of excellent initial rise of triboelectric charges and triboelectric stability of the toner. The above-mentioned specific volume resistivity is a value measured as prescribed in JIS K6911. The above-mentioned specific volume resistivity can be controlled by the step of dissolving a monoazo compound, the step of iron-complex formation reaction or the step of precipitating, filtering, washing-and-purifying the azo-iron complex, or the like.

The above-mentioned azo-iron complex has a volume-median particle size ($D_{50}$) of preferably from 1 to 4 μm, and more preferably from 1 to 3 μm, from the viewpoint of dispersibility of the charge control agent and triboelectric stability of the toner. The above-mentioned average particle size can be controlled by carrying out an iron-complex formation reaction in water or in a water-organic solvent mixed solution, preferably a monohydric lower alcohol-water mixed solution to adjust counterions. The term "volume-median particle size ($D_{50}$)" as used herein means a particle size of which cumulative volume frequency calculated in the volume percentage accounts for 50% calculated from a smaller particle size, which is measured in accordance with the method described in EXAMPLES.

The above-mentioned azo-iron complex is contained in an amount of preferably from 0.1 to 5 parts by weight, and more preferably from 0.5 to 3 parts by weight, based on 100 parts by weight of the resin binder.

A charge control agent other than the above-mentioned azo-iron complex may be properly used within the range that would not impair the effects of the present invention.

It is preferable that the toner of the present invention further contains a wax, from the viewpoint of improving releasing property, stability, and fixing ability.

The wax includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, and deacidified waxes thereof, and fatty acid ester waxes; fatty acid amides, fatty acids, higher alcohols, metal salts of fatty acids, and the like. Among them, the aliphatic hydrocarbon waxes and the ester waxes are preferable, from the viewpoint of improving releasing property and stability; the ester waxes are more preferable, and the carnauba wax is even more preferable, from the viewpoint of improving fixing ability. These waxes may be contained alone or in a mixture of two or more kinds.

The wax has a melting point of preferably from 60° to 100° C., more preferably from 70° to 95° C., and even more preferably from 80° to 90° C., from the viewpoint of improving the low-temperature fixing ability of the toner and dispersibility of the colorant.

The wax is contained in an amount of preferably 4 parts by weight or less, more preferably from 0.5 to 3 parts by weight, and even more preferably from 1 to 2.5 parts by weight, based on 100 parts by weight of the resin binder, from the viewpoint of improving durability of the carrier.

The toner of the present invention may appropriately further be subjected to an internal addition or external addition of an additive such as a colorant, a fluidity improver, an electric conductivity modifier, an extender, a reinforcing filler such as a fibrous substance, an antioxidant, an anti-aging agent, or a cleanability improver.

As the colorant, all of dyes, pigments, and the like which are used as colorants for a toner can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazoyellow, and the like can be used. The colorant is contained in an amount of preferably from 1 to 40 parts by weight, and more preferably from 2 to 10 parts by weight, based on 100 parts by weight of the resin binder. The toner of the present invention may be any of black toners and color toners.

The method for producing a toner may be any of known methods such as a kneading-pulverization method, an emulsion phase-inversion method, and a polymerization method, and the kneading-pulverization method is preferred because the production is facilitated. For example, in the case of a pulverized toner produced by the kneading-pulverization method, a toner can be produced by homogeneously mixing a resin binder, a charge control agent, a colorant, a wax, and the like with a mixer such as a Henschel mixer, thereafter melt-kneading the mixture with a closed kneader, a single-screw or twin-screw extruder, or the like, cooling, pulverizing, and classifying the product.

It is preferable that an external additive is externally added to the surface of the toner.

The external additive has an average particle size of preferably from 10 to 100 nm, from the viewpoint of improving transferability, preventing detachment, and inhibiting aggregation of the toner, and the external additives may be used alone or in a combination of two or more kinds.

In a case where two kinds of external additives are used in a combination, it is preferable that an external additive having an average particle size of from 10 nm or more and less than 30 nm (smaller external additive) and an external additive having an average particle size of from 30 to 100 nm (larger external additive) are used in a combination, from the viewpoint of providing fluidity and preventing the external additive from being embedded. The smaller external additive and the larger external additive are in a weight ratio, i.e. smaller external additive/larger external additive, of preferably from 1/10 to 10/1, and more preferably from 1/5 to 5/1.

The external additive includes fine inorganic particles of silica, alumina, titania, zirconia, tin oxide, zinc oxide, and the like. Among them, silica having a small specific gravity is preferred, from the viewpoint of preventing the external additive from being embedded.

It is preferable that the silica is a hydrophobic silica which is subjected to a hydrophobic treatment, from the viewpoint of environmental stability. The method for hydrophobic treatment is not particularly limited, and the hydrophobic treatment agent includes hexamethyl disilazane (HMDS), dimethyl dichlorosilane (DMDS), silicone oil, methyl triethoxysilane, and the like. Among them, hexamethyl disilazane and dimethyl dichlorosilane are preferable. The amount treated by the hydrophobic treatment agent is preferably from 1 to 7 $mg/m^2$ per surface area of the fine inorganic particles.

The external additive having an average particle size of from 10 to 100 nm is contained in an amount of preferably from 0.1 to 5 parts by weight, and more preferably from 0.3 to 3 parts by weight, based on 100 parts by weight of the toner matrix particles (the toner before the external addition treatment). An external additive having an average particle size of less than 10 nm or an external additive having an average particle size exceeding 100 nm may be properly contained within the range that would not impair the effects of the present invention.

A mixer to be used upon the external addition of the external additive to the toner is preferably an agitator used in dry blending, such as a high-speed agitator such as a Henschel mixer or a Super Mixer, or a V-type blender. The external additive may be previously mixed and added in a high-speed agitator or a V-type blender, or the external additives may be separately added.

The toner of the present invention has a volume-median particle size ($D_{50}$) of preferably from 3 to 15 μm, and more preferably from 4 to 10 μm. The term "volume-median particle size ($D_{50}$)" as used herein means a particle size of which cumulative volume frequency calculated in the volume percentage accounts for 50% calculated from a smaller particle size.

The toner of the present invention, as mentioned above, contains a polyester having a reduced low-molecular weight component, and the low-molecular weight component having a molecular weight of 1,000 or less, contained in the tetrahydrofuran-soluble component of the toner, is contained in an amount of preferably 4.0% by weight or less, more preferably 3.8% by weight or less, and even more preferably 3.6% by weight or less, of the entire soluble component.

The toner of the present invention has a storage modulus G' at 50° C. in a frequency of 6.28 rad/s of preferably from $3.0\times10^7$ to $3.0\times10^8$ Pa, and more preferably from $4.0\times10^7$ to $8.0\times10^7$ Pa, from the viewpoint of satisfying both of prevention of the external additive of the toner in the developer device from being embedded, thereby maintaining a stable image density, and low-temperature fixing ability. The storage modulus of the toner can be adjusted with a raw material monomer of the resin binder or a low-molecular weight component of the toner.

The tetrahydrofuran-soluble component of the toner has a number-average molecular weight of preferably from 2,000 to 5,000, and more preferably from 2,500 to 4,500, and a weight-average molecular weight of preferably from 8,000 to 15,000, and more preferably from 9,000 to 14,000, from the viewpoint of preventing the external additive from being embedded, maintaining image density, and improving low-temperature fixing ability.

The toner of the present invention has a softening point of preferably from 90° to 120° C., and more preferably from 1000 to 110° C., from the viewpoint of low-temperature fixing ability and durability of the toner. In addition, the toner has a glass transition temperature of preferably from 50° to 70° C., and more preferably from 550 to 65° C., from the viewpoint of low-temperature fixing ability and smearing property of the toner.

Since the toner of the present invention has excellent low-temperature fixing ability and favorable transferability and further has excellent smearing property, the toner is suitably used in an apparatus for forming fixed images according to a non-contact fusing method, such as oven fusing or flash fusing. The toner can be suitably used also in an apparatus for forming fixed image using a high speed having a linear speed of from 800 mm/sec or more, and preferably from 1,000 to 3,000 mm/sec. Here, the term "linear speed" refers to a processing speed for an apparatus for forming fixed images, which is determined by a paper-feeding speed at a fixing member. Incidentally, when the toner of the present invention is used in an apparatus for forming fixed images according to a contact fusing method, hot offset is generated, so that the toner is not suitably used as a toner for contact fusing.

In addition, a method for development of the toner of the present invention is not particularly limited, and the toner can be suitably used also in an apparatus for forming fixed images according to a non-contact development method, because an external additive is less likely to be embedded in the toner surface, so that the toner has excellent triboelectric chargeability, transferability, and durability.

The toner of the present invention can be used directly as a toner for monocomponent development, or mixed with a carrier to prepare a two-component developer.

In the present invention, as the carrier, a carrier having a low saturation magnetization which has a weaker contact with substrates such as a photoconductor roller is preferable, from the viewpoint of the image properties. The carrier has a saturation magnetization of preferably from 40 to 100 $Am^2$/kg, and more preferably from 50 to 90 $Am^2$/kg. The carrier has a saturation magnetization of preferably 100 $Am^2$/kg or less, from the viewpoint of controlling the hardness of the magnetic brush and retaining the tone reproducibility, and the carrier has a saturation magnetization of preferably 40 $Am^2$/kg or more, from the viewpoint of preventing the carrier from being adhered and toner dust.

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; glass beads; and the like. Among them, magnetite, ferrite, copper-zinc-magnesium ferrite, and manganese ferrite are preferable, from the viewpoint of triboelectric chargeability.

The surface of the carrier can be coated with a resin, from the viewpoint of preventing the formation of toner scumming on the carrier. The resin for coating the surface of the carrier may vary depending upon the toner materials, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. These resins can be used alone or in a combination of two or more kinds. The method of coating a core material with a resin is not particularly limited, and includes, for example, a method of dissolving or suspending a coating material such as a resin in a solvent, and applying the solution or suspension to be deposited on a core material, a method of simply blending in the state of powder, and the like.

In a two-component developer obtained by mixing the toner with a carrier, the toner is contained in an amount of preferably from 0.5 to 10 parts by weight, and more preferably from 2 to 8 parts by weight, based on 100 parts by weight of the carrier, from the viewpoint of fluidity of the developer, and reduction of background fogging and generation of dust.

EXAMPLES

The following examples further describe and demonstrate embodiments of the present invention. The examples are given solely for the purposes of illustration and are not to be construed as limitations of the present invention.

[Softening Points (Tm) of Resins and Toners]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a sample is prepared by applying a load of 1.96 MPa thereto with the plunger and extruding a 1 g sample through a nozzle having a die pore size of 1 mm and a length of 1 mm, while heating the sample so as to raise the temperature at a rate of 6° C./min.

[Glass Transition Temperatures (Tg) of Resins and Toners]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Values of Resins]

The acid values are measured as prescribed by a method of JIS K0070, provided that only a measurement solvent is changed from a mixed solvent of ethanol and ether as prescribed in JIS K0070 to a mixed solvent of acetone and toluene (acetone:toluene=1:1 (volume ratio))

[Volume-Median Particle Size ($D_{50}$) of Charge Control Agents]

| | |
|---|---|
| Measuring Apparatus: | Laser Scattering Particle Size Analyzer (commercially available from Horiba, LTD., LA-920) |
| Dispersion: | "EMULGEN 109P" (commercially available from Kao Corporation, polyoxyethylene lauryl ether, HLB: 13.6) is dissolved in distilled water so as to have a concentration of 5% by weight to provide a dispersion. |
| Dispersion Conditions: | Ten milligrams of a measurement sample is added to 5 ml of the above dispersion, and the mixture is dispersed for 5 minutes with a ultrasonic disperser, and 5 ml of distilled water is added to the dispersion, and further dispersed with a ultrasonic disperser for 5 minutes, to prepare a sample dispersion. |
| Measurement Conditions: | The distilled water is added to a cell to be measured, and 0.1 ml of the sample dispersion obtained is introduced into the measurement device. Thereafter, a volume-median particle size ($D_{50}$) is measured at a temperature in which the absorbance takes an appropriate range. |

[Specific Volume Resistivity of Charge Control Agents]

The specific volume resistivity is measured as prescribed in JIS K6911.

Specifically, a sample is placed in an aluminum ring having a diameter of 40 mm, and molded with a pressure of 500 kgf/cm$^2$, and a specific volume resistivity is measured with a resistivity meter LORESTA AP (commercially available from DIA Instruments Co., Ltd.) according to a 4-terminal, 4-probe, constant electric current application method. Here, the room temperature is from 20° to 25° C., and relative humidity is from 40 to 60%.

[Melting Point of Waxes]

A temperature of maximum endothermic peak of the heat of fusion obtained by raising the temperature of a sample to 200° C. using a differential scanning calorimeter ("DSC 210," commercially available from Seiko Instruments, Inc.), cooling the sample from this temperature to 0° C. at a cooling rate of 10° C./min, and thereafter raising the temperature of the sample at a heating rate of 10° C./min, is referred to as a melting point.

[Volume-Median Particle Size ($D_{50}$) of Toners]

| | |
|---|---|
| Measuring Apparatus: | Coulter Multisizer II (commercially available from Beckman Coulter, Inc.) |
| Aperture Diameter: | 50 μm |
| Analyzing Software: | Coulter Multisizer AccuComp Ver. 1.19 (commercially available from Beckman Coulter, Inc.) |
| Electrolytic Solution: | "Isotone II" (commercially available from Beckman Coulter, Inc.) |
| Dispersion: | "EMULGEN 109P" (commercially available from Kao Corporation, polyoxyethylene lauryl ether, HLB: 13.6) is dissolved in the above electrolytic solution so as to have a concentration of 5% by weight to provide a dispersion. |
| Dispersion Conditions: | Ten milligrams of a measurement sample is added to 5 ml of the above dispersion, and the mixture is dispersed for 1 minute with an ultrasonic disperser, and 25 ml of an electrolytic solution is added to the dispersion, and further dispersed with an ultrasonic disperser for 1 minute, to prepare a sample dispersion. |
| Measurement Conditions: | The above sample dispersion is added to 100 ml of the above electrolytic solution to adjust to a concentration at which particle sizes of 30,000 toner particles can be measured in 20 seconds, and thereafter the 30,000 particles are measured, and a volume-median particle size ($D_{50}$) is obtained from the particle size distribution. |

[Number-Average Molecular Weight (Mn), Weight-Average Molecular Weight (Mw), and Content of Low-Molecular Weight Component of Toners]

The number-average molecular weight and the weight-average molecular weight are obtained from the molecular weight distribution determined by the gel permeation chromatography (GPC) according to the following method.

(1) Preparation of Sample Solution

A toner is dissolved in tetrahydrofuran, so as to have a concentration of 0.5 g/100 ml. Each of the resulting solution is then filtered with a fluororesin filter ("FP-200," commercially available from Sumitomo Electric Industries, Ltd.) having a pore size of 2 μm to remove insoluble components, to provide a sample solution.

(2) Determination of Molecular Weights

Using the following measurement apparatus and analyzing column, tetrahydrofuran is allowed to flow as an eluate at a rate of 1 ml per minute, and the column is stabilized in a thermostat at 40° C. One-hundred microliters of the sample solution is injected to the column to determine a molecular weight. The molecular weight of the sample is calculated on the basis of a calibration curve previously prepared. The calibration curve of the molecular weight is prepared by using several kinds of monodisperse polystyrenes (A-500 ($5.0\times10^2$), A-1000 ($1.01\times10^3$), A-2500 ($2.63\times10^3$), A-5000 ($5.97\times10^3$), F-1 ($1.02\times10^4$), F-2 ($1.81\times10^4$), F-4 ($3.97\times10^4$), F-10 ($9.64\times10^4$), F-20 ($1.90\times10^5$), F-40 ($4.27\times10^5$), F-80 ($7.06\times10^5$), and F-128 ($1.09\times10^6$), each commercially available from Tosoh Corporation) as standard samples.

| | |
|---|---|
| Measurement Apparatus: | HLC-8220GPC (commercially available from Tosoh Corporation) |
| Analyzing Column: | GMHLX + G3000HXL (commercially available from Tosoh Corporation) |

The content of the low-molecular weight component having a molecular weight of 1,000 or less, contained in the tetrahydrofuran-soluble component contained in the toner is obtained from an integral value of the molecular weight distribution obtained by the above-mentioned determination.

[Storage Modulus (G') of Toners]

The storage modulus is measured using a viscoelastometer (rheometer) Model RDA-III (commercially available from Rheometrics Scientific Inc.).

| | |
|---|---|
| Measurement Jig: | Parallel plates having a diameter of 25 mm are used. |
| Measurement Sample: | 1 g of a toner |
| Measurement Conditions: | The measurement is started at 120° C., and the sample is cooled to 40° C. Thereafter, the sample is reheated from 40° to 160° C. The storage modulus at 50° C. upon this reheating is defined as G'(50). |

The conditions of the measurement apparatus are set as follows.

| | |
|---|---|
| Geometry: | Parallel Plates (25 mm) |
| Radius: | 12.5 (mm) |
| Gap: | Gap at 120° C. |

The internal temperature of the measurement apparatus is raised to 120° C., and 1 g of a toner is then placed on the parallel plates. A molten toner is tightly adhered to the upper and lower plates. When Axal Force is 0, Gap is inputted.

1. Dynamic Mechanical Analysis
   Frequency/Temperature Sweep
2. Test Parameters
   Strain: 0.05(%)
   Initial Temperature: 40(° C.)
3. Sweep Parameters
   Sweep Type: Discrete
   Final temperature: 160(° C.)
   Step Size: 1(° C.)
   Soak Time: 30 (s)
   Frequency: 6.28 (rad/s)
4. Options
   Delay Before Test: 30 (s)
   Correlation Delay: 0.0 (Cycles)
   1 Cycle Correlation: No
   Auto tension: Yes

[Average Particle Size of External Additive]

The average particle size of the external additive refers to a number-average particle size, and particle sizes (an average of length and breadth) of 500 particles are measured from a photograph taken with a scanning electron microscope (SEM), and an average thereof is defined as an average particle size.

[Saturation Magnetization of Carrier]

(1) A carrier is filled in a plastic case with a lid with tapping, the case having an outer diameter of 7 mm (inner diameter of 6 mm) and a height of 5 mm. The mass of the carrier is determined from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturation magnetization is determined by applying a magnetic field of 79.6 kA/m, while vibrating the plastic case using the vibration function. The value obtained is calculated as the saturation magnetization per unit mass, taking into consideration the mass of the filled carrier.

Production Example 1 for Resins [Resins A and D]

A 5-liter four-neck flask equipped with a nitrogen inlet tube, a dehydration tube, a stirrer, and a thermocouple were charged with raw material monomers listed in Table 1 and 19.5 g of an esterification catalyst (dibutyltin oxide), and the components were heated to 230° C. and allowed to react until a reaction percentage reached 90%. Further, the reaction mixture was allowed to react at 8.3 kPa for 1 hour, to provide each of resins A and D. Here, the reaction percentage as used in the present invention is a value obtained by the formula of [amount of reaction water (mol)/theoretical amount of generated water (mol)]×100.

Production Example 2 for Resin [Resin B]

A 5-liter four-neck flask equipped with a nitrogen inlet tube, a dehydration tube, a stirrer, and a thermocouple were charged with raw material monomers listed in Table 1, 2 g of a polymerization inhibitor (hydroquinone), and 19.5 g of an esterification catalyst (dibutyltin oxide), and the components were heated to 230° C. and allowed to react until a reaction percentage reached 90%. Further, the reaction mixture was allowed to react at 8.3 kPa for 1 hour, to provide a resin B.

Production Example 3 for Resin [Resin C]

A 5-liter four-neck flask equipped with a nitrogen inlet tube, a dehydration tube, a stirrer, and a thermocouple were charged with BPA-PO, BPA-EO, and isophthalic acid, each listed in Table 1, and 19.5 g of an esterification catalyst (dibutyltin oxide), and the components were allowed to react at 230° C. for 5 hours, and further at 8.3 kPa for 1 hour. The reaction mixture was cooled to 210° C., fumaric acid listed in Table 1 and 2 g of a polymerization inhibitor (hydroquinone) were added thereto. The mixture was allowed to react for 5 hours, and thereafter the mixture was further allowed to react at 8.3 kPa until the reaction mixture reached a desired softening point, to provide a resin C.

TABLE 1

| | Linear Polyesters | | | |
|---|---|---|---|---|
| | Resin A | Resin B | Resin C | Resin D |
| BPA-PO[1)] | 980 g (35) | 2688 g (96) | 980 g (35) | 980 g (35) |
| BPA-EO[2)] | 1690 g (65) | — | 1690 g (65) | 1690 g (65) |
| Fumaric Acid | — | 929 g (100) | 279 g (30) | — |
| Isophthalic Acid | 1223 g (92) | — | 930 g (70) | — |
| Terephthalic Acid | — | — | — | 1223 g (92) |
| Softening Point (° C.) | 109.5 | 101.2 | 110.5 | 111.2 |
| Glass Transition Temperature (° C.) | 63.5 | 61.1 | 60.1 | 65.5 |
| Acid Value (mgKOH/g) | 3.9 | 19.5 | 8.5 | 4.8 |

Note)
The numerical values inside the parentheses are expressed by molar ratio.
[1)]Propylene oxide adduct of bisphenol A (2.2 mol).
[2)]Ethylene oxide adduct of bisphenol A (2.2 mol).

Production Example of Charge Control Agent

To 1,000 liters of water were added 2,387 g of 4-tert-butyl-2-aminophenol and 450 g of a concentrated hydrochloric acid, while stirring. Thereafter, the reaction mixture was cooled to 0° C., and an aqueous sodium nitrite solution (34% by weight) was added dropwise thereto, to give a diazonium salt solution. Further, to an aqueous solution previously prepared by dissolving 330 g of naphthol AS and 192 g of potassium hydroxide in 2 liters of water were added dropwise the above-mentioned diazonium salt solution and butanol, the precipitates were filtered, and then washed with ion-exchanged water, to give 1,430 g of a wet cake.

To the wet cake was added 2.8 liters of a liquid mixture of 1 liter of butanol and 1.8 liters of water, 105 g of a 45% by weight aqueous potassium hydroxide solution was then added thereto, and the mixture was stirred at 90° C. for 1 hour. Further, 141 g of a 35% by weight aqueous ferric sulfate solution was added dropwise thereto. Thereafter, the mixture was refluxed at 100° C. for 6 hours, to give 294 g of a charge control agent A. The charge control agent A represented by the formula (Ia):

(Ia)

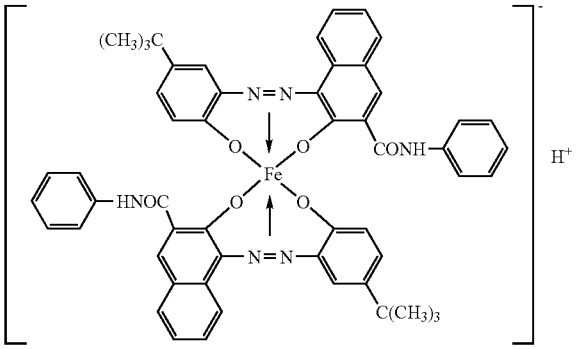

had a volume-median particle size ($D_{50}$) of 1.4 μm and a specific volume resistivity of $1.21\times10^{15}$ Ωcm.

Examples 1 to 5 and Comparative Examples 1 to 8

A resin binder and a charge control agent each listed in Table 2, 2 parts by weight of a wax "Carnauba Wax No. 1" (commercially available from S. Kato & CO., melting point 81° C.), and 6 parts by weight of a carbon black "NIPEX60" (commercially available from Evonic Degussa Japan Co., Ltd.) were added together, and the components were mixed with a Henschel mixer for 60 seconds. The resulting mixture was melt-kneaded with a twin-screw extruder, the melt-kneaded mixture was cooled, and roughly pulverized with a hammer mill to a size of 1 mm or so. The resulting roughly pulverized product was finely pulverized with an air-jet pulverizer, and the finely pulverized product was classified, to provide toner matrix particles having a volume-median particle size ($D_{50}$) of 8.5 μm.

One-hundred parts by weight of the resulting toner matrix particles, 0.9 parts by weight of a hydrophobic silica "R972" (commercially available from Nihon Aerosil Co., Ltd., hydrophobic treatment agent: DMDS, average particle size: 16 nm) and 1.0 part by weight of a hydrophobic silica "NAX50" (commercially available from Nihon Aerosil Co., Ltd., hydrophobic treatment agent: HMDS, average particle size: 50 nm) were mixed with a Henschel mixer for 3 minutes, to provide a toner. The physical properties of the resulting toner are also shown together in Table 2.

Here, the charge control agent "T-77" (commercially available from Hodogaya Chemical Industries Co., Ltd.) used in Comparative Examples 1 to 5 is an azo-iron complex represented by the following formula (III):

(III)

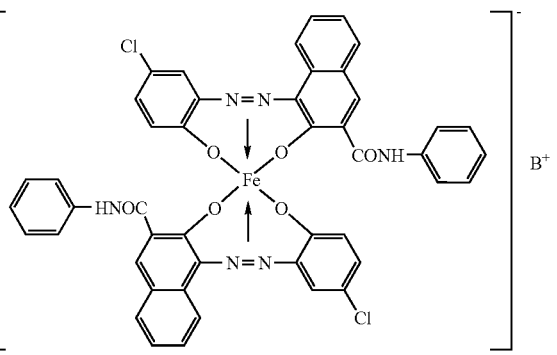

wherein $B^+$ is mixed cations of ammonium ion, sodium ion, and hydrogen ion.

TABLE 2

| | Resin Binders (Amount Used) | Charge Control Agent (Amount Used) | Physical Properties of Toner | | | | | |
|---|---|---|---|---|---|---|---|---|
| | | | Tm (° C.) | Tg (° C.) | Mn | Mw | Low-Molecular Weight Component (% by weight) Having Molecular Weight of 1,000 or less | G' (Pa) at 50° C. |
| Example 1 | Resin A/Resin B (70/30) | Charge Control Agent A (1) | 106.6 | 59.5 | 4,300 | 12,800 | 3.2 | $4.8\times10^7$ |
| Example 2 | Resin A/Resin B (50/50) | Charge Control Agent A (1) | 103.4 | 57.5 | 4,100 | 12,400 | 3.8 | $3.5\times10^7$ |
| Example 3 | Resin A/Resin B (90/10) | Charge Control Agent A (1) | 109.5 | 60.1 | 4,400 | 13,000 | 3.5 | $4.2\times10^7$ |
| Example 4 | Resin C (100) | Charge Control Agent A (1) | 107.1 | 57.1 | 4,500 | 12,500 | 3.5 | $4.1\times10^7$ |
| Example 5 | Resin A (100) | Charge Control Agent A (1) | 110.2 | 59.2 | 4,300 | 13,000 | 3.3 | $4.9\times10^7$ |
| Comparative Example 1 | Resin A/Resin B (70/30) | T-77 (1) | 106.4 | 58.9 | 4,300 | 12,900 | 3.3 | $4.5\times10^7$ |
| Comparative Example 2 | Resin A/Resin B (50/50) | T-77 (1) | 103.5 | 56.4 | 4,100 | 12,400 | 3.7 | $3.7\times10^7$ |
| Comparative Example 3 | Resin A/Resin B (90/10) | T-77 (1) | 108.1 | 60.1 | 4,400 | 13,000 | 3.4 | $4.3\times10^7$ |
| Comparative Example 4 | Resin C (100) | T-77 (1) | 106.8 | 56.8 | 4,400 | 12,500 | 3.5 | $3.9\times10^7$ |
| Comparative Example 5 | Resin B/Resin D (30/70) | T-77 (1) | 107.1 | 61.4 | 3,600 | 12,800 | 5.9 | $2.6\times10^7$ |
| Comparative Example 6 | Resin B/Resin D (30/70) | Charge Control Agent A (1) | 107.8 | 61.8 | 3,700 | 12,800 | 5.8 | $2.5\times10^7$ |
| Comparative | Resin B (100) | Charge Control Agent A (1) | 99.8 | 55.8 | 4,000 | 14,500 | 4.1 | $2.5\times10^7$ |

TABLE 2-continued

| | Resin Binders (Amount Used) | Charge Control Agent (Amount Used) | Physical Properties of Toner | | | | | |
|---|---|---|---|---|---|---|---|---|
| | | | Tm (° C.) | Tg (° C.) | Mn | Mw | Low-Molecular Weight Component (% by weight) Having Molecular Weight of 1,000 or less | G' (Pa) at 50° C. |
| Example 7 | | | | | | | | |
| Comparative Example 8 | Resin D (100) | Charge Control Agent A (1) | 110.5 | 63.1 | 3,600 | 11,900 | 5.3 | $2.8 \times 10^7$ |

Note 1)
Amounts of Resin Binders and Charge Control Agent Used are expressed by parts by weight.
Note 2)
T77: Commercially available from Hodogaya Chemical Industries Co., Ltd., hydrophobic silica, average particle size: 16 nm Test Example 1 [Low-Temperature Fixing Ability]

Six parts by weight of the resulting toner and 94 parts by weight of a ferrite carrier (volume-average particle size: 60 μm, saturation magnetization: 68 $Am^2/kg$) were mixed together, to provide a two-component developer.

The resulting two-component developer was loaded on a copy machine "AR-505" (commercially available from Sharp Corporation), and adjustment was made so that the amount of toner would be 0.6 $mg/cm^2$. Thereafter, images at the stage before fixing were taken out to provide unfixed images. The unfixed images were fixed with an external fixing device, a modified fixing device for an apparatus for forming fixed images according to a non-contact fusing method "Vario stream 9000" (commercially available from Oce Printing Systems GmbH) by sequentially raising the temperature on paper from 90° to 150° C., to provide fixed images. "UNICEF Cellophane" tape (commercially available from MITSUBISHI PENCIL CO., LTD., width: 18 mm, JIS Z-1522) was adhered to the fixed images obtained at each fixing temperature, the tape was pressed with a roller so as to apply a load of 500 g, and the tape was then removed. The image densities before and after the removal of the tape were measured. The temperature on paper at which the ratio of the image density after removal of tape/before removal of tape initially exceeds 90% is defined as the lowest fixing temperature, and the low-temperature fixing ability was evaluated. The lower the lowest fixing temperature, the more excellent the low-temperature fixing ability. Paper used in the fixing test was a paper "Copy Bond SF-70NA" (75 $g/m^2$) commercially available from Sharp Corporation. The results are shown in Table 3.

Test Example 2 [Transferability and Image Density]

A two-component developer obtained in the same manner as in Test Example 1 was loaded on an apparatus for forming fixed images according to a non-contact development method "Vario stream 9000" (commercially available from Oce Printing Systems GmbH), and a durability printing test was conducted at a print coverage of 9%, a linear speed of 1,000 mm/sec for 2 hours. Thereafter, a durability printing test was conducted at a print coverage of 0.15% for 3 hours, the printer was imperatively halted, and the amount of the toner on a photoconductor (To) and the amount of the toner on paper (Tp) were weighed. Defining a value calculated by the formula of Tp/To×100 as the transfer efficiency, the transferability was evaluated. The higher the transfer efficiency, the more excellent the transferability. The results are shown in Table 3.

Also, image samples obtained immediately before the hard stop were collected, and the image densities were measured with a calorimeter "GretagMacbeth Spectroeye" (commercially available from GretagMacbeth CO.) at 5 points of the printed portion of the fixed images, and an average was calculated as an image density (ID) to evaluate image densities.

Test Example 3 [Smearing Property]

A two-component developer obtained in the same manner as in Test Example 1 was loaded on an apparatus for forming fixed images according to a non-contact development method "Vario stream 9000" (commercially available from Oce Printing Systems GmbH), and printing was conducted at a print coverage of 9%, and a linear speed of 1,000 mm/sec to provide printouts. A 500 g stainless weight having a length of 3 cm, a width of 3 cm, and a height of 6.5 cm was placed on the printouts obtained, and the weight was reciprocated over the printed characters at a speed of 0.5 m/s. Supposing that one reciprocation was counted as once, the smearing property was evaluated in accordance with the following evaluation criteria on the basis of the number of times at which a toner adhesion in a black banded state initially appeared in non-printing portions. The larger the number of times, the more excellent the smearing property. The results are shown in Table 3.

[Evaluation Criteria]

A: The number of times is 20 or more.

B: The number of times is 15 or more and less than 20.

C: The number of times is less than 15.

Test Example 4 [Triboelectric Chargeability]

A two-component developer obtained in the same manner as in Test Example 1 was loaded on an apparatus for forming fixed images according to a non-contact development method "Vario stream 9000" (commercially available from Oce Printing Systems GmbH), and printing was conducted at a print coverage of 9% for 2 hours. Thereafter, the developer was taken out of the developer vessel, and the triboelectric charges were measured with a q/m meter (500 mesh being used) commercially available from Epping GmbH. The triboelectric chargeability was evaluated in accordance with the following evaluation criteria. The larger the absolute value of the triboelectric charges, the more excellent the triboelectric chargeability. The results are shown in Table 3.

[Evaluation Criteria]

A: The triboelectric charges are −25 μC/g or more.

B: The triboelectric charges are −20 μC/g or more and less than −25 μC/g.

C: The triboelectric charges are −15 μC/g or more and less than −20 μC/g.

D: The triboelectric charges are less than −15 μC/g.

Test Example 5 [Toner Dust]

A two-component developer obtained in the same manner as in Test Example 1 was loaded on an apparatus for forming fixed images according to a non-contact development method "Vario stream 9000" (commercially available from Oce Printing Systems GmbH), and printing was conducted at a print coverage of 9% for 2 hours. Thereafter, the developer was taken out from a developer vessel, and the presence or absence of the adhesion of the toner dust to the developer vessel was visually judged, and the toner dust was evaluated in accordance with the following evaluation criteria. The smaller the amount of the toner dust, the more excellent the toner dust. The results are shown in Table 3.

[Evaluation Criteria]

A: The toner dust is not found at all.

B: The toner dust is found in a slight amount.

C: The toner dust is found in a notable amount.

D: The toner dust is found in a large amount.

TABLE 3

| | Low-Temperature Fixing Ability [Lowest Fixing Temp. (° C.)] | Transferability [Transfer Efficiency (%)] | Image Density | Smearing Property | Triboelectric Chargeability | Toner Dust |
|---|---|---|---|---|---|---|
| Example 1 | 119 | 83 | 1.9 | A | A | A |
| Example 2 | 114 | 84 | 1.8 | A | B | B |
| Example 3 | 122 | 83 | 1.9 | A | A | A |
| Example 4 | 118 | 81 | 1.8 | A | B | B |
| Example 5 | 128 | 82 | 1.8 | A | A | A |
| Comparative Example 1 | 119 | 85 | 1.9 | C | C | D |
| Comparative Example 2 | 115 | 81 | 1.8 | C | D | D |
| Comparative Example 3 | 123 | 88 | 1.9 | C | C | D |
| Comparative Example 4 | 118 | 80 | 1.8 | C | D | D |
| Comparative Example 5 | 121 | 65 | 1.4 | C | C | D |
| Comparative Example 6 | 115 | 58 | 1.3 | B | D | D |
| Comparative Example 7 | 107 | 83 | 1.8 | B | D | D |
| Comparative Example 8 | 130 | 48 | 1.1 | B | C | C |

It can be seen from the above results that the toners of Examples 1 to 5 are excellent in both low-temperature fixing ability and triboelectric chargeability, and are excellent in smearing property and effective in the reduction of toner dust, and maintain favorable transfer efficiency and image density even in durability printing at a low print coverage, as compared to the toners of Comparative Examples 1 to 8.

The toner for electrostatic image development of the present invention is suitably used in developing latent images formed in, for example, electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development comprising (a) a resin binder and (b) a charge control agent, wherein the resin binder comprises a polyester A obtained by polycondensing an alcohol component and a carboxylic acid component comprising isophthalic acid and/or an ester thereof, and wherein the charge control agent comprises an azo-iron complex represented by formula (I):

(I)

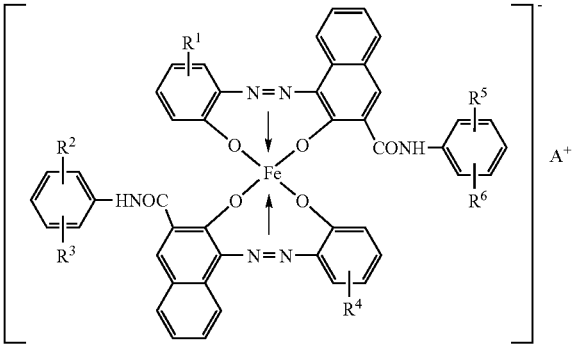

wherein both $R^1$ and $R^4$ are a tert-butyl group; each of $R^2$, $R^3$, $R^5$, and $R^6$ are a hydrogen atom; and $A^+$ is a cation, wherein the charge control agent is dispersed in the toner, wherein the alcohol component comprises an alkylene oxide adduct of bisphenol A represented by formula (II):

(II)

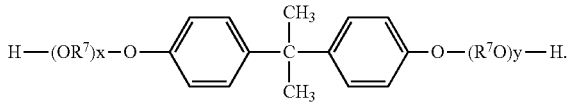

wherein each of $R^7O$ and $OR^7$ is an oxyalkylene group, wherein $R^7$ is an ethylene group and/or a propylene group; and x and y are the number of moles of alkylene oxides added, each being a positive number, wherein an average of the sum of x and y is from 1 to 16, wherein the isophthalic acid of polyester A is contained in an amount of at least 50% by mol of the carboxylic acid component, and wherein the amount of polyester component in the resin binder is 100% by weight and the amount of polyester A is at least 50% by weight of the polyester component.

2. The toner according to claim 1, wherein a low-molecular weight component having a molecular weight of 1,000 or less contained in a tetrahydrofuran-soluble component of the toner is contained in an amount of 4.0% by weight or less.

3. The toner according to claim 1, wherein the toner has a softening point of from 90° to 120° C.

4. The toner according to claim 1, wherein the resin binder further comprises a polyester B obtained by polycondensing an alcohol component and a carboxylic acid component comprising one or more members selected from the group consisting of fumaric acid, maleic acid, maleic anhydride, and esters thereof.

5. The toner according to claim 4, wherein the polyester A and the polyester B are in a weight ratio (A/B) of from 90/10 to 50/50.

6. The toner according to claim 1, wherein a tetrahydrofuran-soluble component of the toner has a number-average molecular weight of from 2,000 to 5,000, and a weight-average molecular weight of from 8,000 to 15,000.

7. The toner according to claim 1, wherein the toner is capable of functioning as a toner for non-contact fusing.

8. A method of forming fixed images comprising applying the toner as defined in claim 1 to an image-forming apparatus according to a non-contact fusing method.

9. The toner according to claim 1, wherein the polyester A has an acid value of less than 6 mg KOH/g.

10. The toner according to claim 1, wherein the polyester A has a glass transition temperature of from 50° to 85° C.

11. The toner according to claim 1, wherein the polyester A is obtained by polycondensing an alcohol component and a carboxylic acid component comprising an isophthalic acid compound and a fumaric acid/maleic acid compound.

12. The toner according to claim 1, wherein the toner further comprises at least one wax selected from the group consisting of an aliphatic hydrocarbon wax, an ester wax, and a fatty acid ester wax.

13. The toner according to claim 1, wherein the charge control agent is represented by formula (Ia):

(Ia)

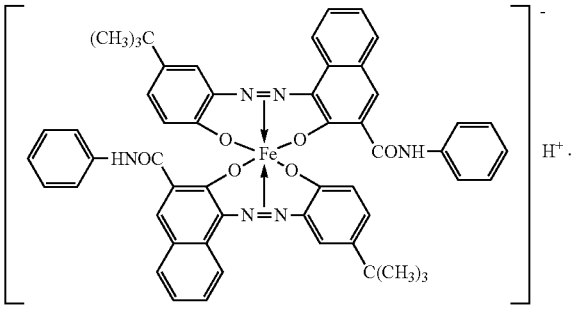

14. The toner according to claim 1, wherein the isophthalic acid of polyester A is contained in an amount of at least 70% by mol of the carboxylic acid component.

15. The toner according to claim 1, wherein the isophthalic acid of polyester A is contained in an amount of at least 90% by mol of the carboxylic acid component thereof.

16. The toner according to claim 4, wherein the total of one or more members selected from the group consisting of fumaric acid, maleic acid, maleic anhydride, and esters thereof of polyester B is/are contained in an amount of at least 50% by mol of the carboxylic acid component thereof.

17. The toner according to claim 4, wherein the total of one or more members selected from the group consisting of fumaric acid, maleic acid, maleic anhydride, and esters thereof of polyester B is/are contained in an amount of at least 90% by mol of the carboxylic acid component thereof.

18. The toner according to claim 4, wherein isophthalic acid is present in an amount of 5% by mol of less, including 0, in the carboxylic acid component of polyester B, and the total of one or more members selected from the group consisting of fumaric acid, maleic acid, maleic anhydride, and esters thereof is/are present in an amount of 5% by mol of less, including 0, in the carboxylic acid component of polyester A.

19. The toner according to claim 1, wherein the polyester A has an acid value of less than 4 mg KOH/g.

20. The toner according to claim 1, wherein the polyester A is a linear polyester.

* * * * *